US005876279A

United States Patent [19]

Renz et al.

[11] Patent Number: 5,876,279

[45] **Date of Patent: *Mar. 2, 1999**

[54] BLOWER UNIT FOR CLEAN ROOM

[75] Inventors: Manfred Renz, Ditzingen; Helmut Bauer, Tamm, both of Germany

[73] Assignee: Meissner + Wurst GmbH + Co. Lufttechnische Anlagen Gebaude—und Verfahrenstechnik, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 624,809

[22] Filed: Mar. 27, 1996

[30] Foreign Application Priority Data

Mar. 27, 1995 [DE] Germany ..... 195 11 158.3

[51] Int. Cl.[6] ..... B01L 1/04

[52] U.S. Cl. ..... 454/187

[58] Field of Search ..... 454/187, 906

[56] References Cited

U.S. PATENT DOCUMENTS

| | | | |
|---|---|---|---|
| 4,560,395 | 12/1985 | Davis | 454/187 |
| 4,790,863 | 12/1988 | Nobiraki et al. | 454/187 |
| 5,297,990 | 3/1994 | Renz et al. | 454/187 |
| 5,462,484 | 10/1995 | Jung et al. | 454/187 |

FOREIGN PATENT DOCUMENTS

| | | |
|---|---|---|
| 2138985 | 2/1973 | Germany . |
| 3513902 | 10/1985 | Germany . |
| 4103026 | 9/1992 | Germany . |
| 4238595 | 5/1994 | Germany . |
| 9309389 | 5/1993 | WIPO . |

*Primary Examiner*—John T. Kwon

*Attorney, Agent, or Firm*—Robert W. Becker & Associates

[57] ABSTRACT

A blower unit for clean rooms has a housing with a bottom, a cover, and first and second sidewalls. A filter is connected to the bottom. At least one blower is mounted in the housing. At least one air flow channel is connected to the blower and extends within the housing in an upward direction between two opposite ones of the first sidewalls. In the airflow channel clean air flows from the blower to the filter. Soundproofing material is connected to at least one side of the airflow channel.

12 Claims, 4 Drawing Sheets

Fig.1
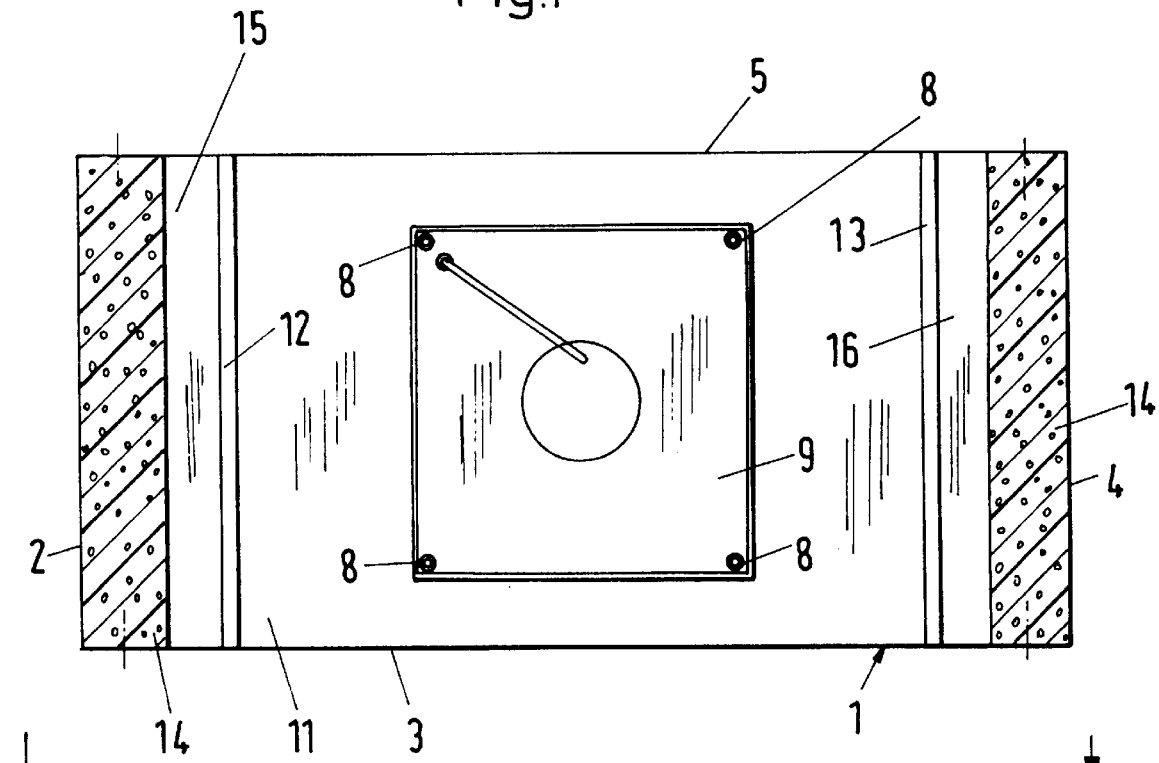
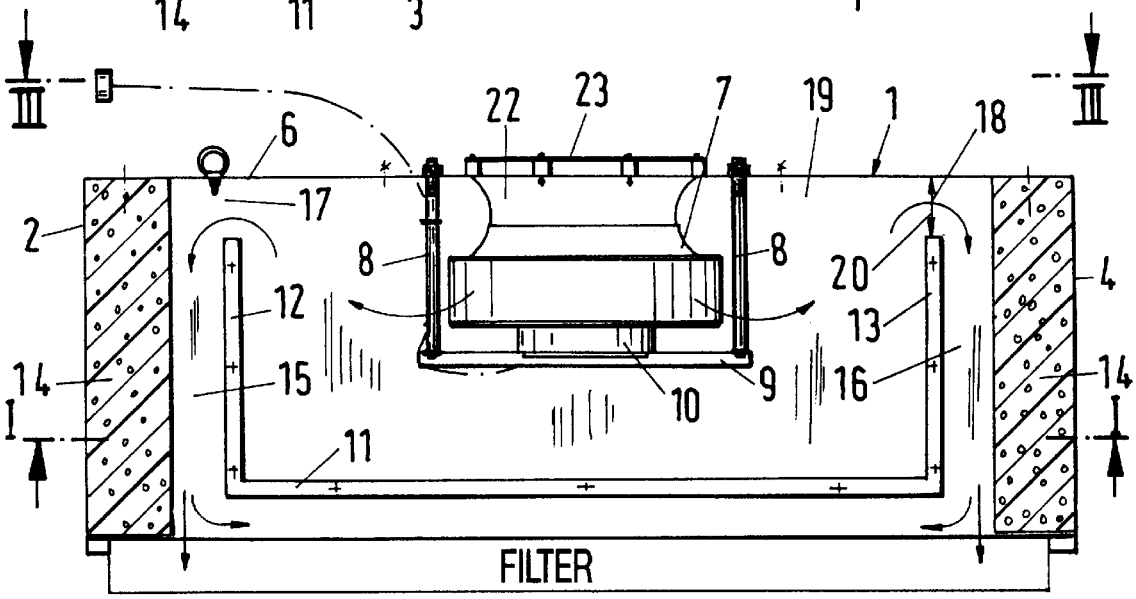
Fig.2

BLOWER UNIT FOR CLEAN ROOM

BACKGROUND OF THE INVENTION

The present invention relates to a blower unit for clean rooms having a housing in which at least one blower is contained which is in communication with at least one air flow channel in which the clean air flows from the blower to a filter.

In these known blower units (German Offenlegungsschrift 42 38 595 and German Offenlegungsschrift 35 13 902) the airflow channel which is connected to the blower is positioned transverse to the axis of the blower. Furthermore, the air flow channel is comprised of two sections that extend parallel to one another so that the clean air upon flowing from one section into the other must be deflected by 180°. In this manner, the length of the flow path for the clean air which is required for the desired sound muffling is provided. Such blower units are, in general, mounted within a grid structure so that the exterior dimensions of the blower unit are predetermined. For this purpose, the flow path of the clean air transverse to the axis of the blower cannot be selected to be as long as desired. The sound muffling or soundproofing is thus limited with respect to the grid structure.

It is therefore an object of the present invention to improve the aforementioned blower unit such that an optimal soundproofing can be achieved in a constructively simple and inexpensive manner while taking into consideration the preselected grid structure and grid dimensions of the blower unit.

SUMMARY OF THE INVENTION

The blower unit for a clean room according to the present invention is primarily characterized by:

- a housing having a bottom, a cover, and first and second sidewalls;
- a filter connected to the bottom;
- at least one blower mounted in the housing;
- at least one airflow channel connected to the blower and extending within the housing in an upward direction between two first opposite sidewalls, wherein in the airflow channel clean air flows from the blower to the filter; and
- a soundproofing material connected to at least one side of the airflow channel.

Preferably, the airflow channel is limited by at least one upwardly extending wall with a free end spaced at a distance to the cover, wherein between the cover and the free end a flow opening is defined.

Advantageously, the at least one upwardly extending wall is connected to the two first opposite sidewalls.

Advantageously, two airflow channels are provided.

Preferably, two airflow channels extend parallel to one another.

In yet another embodiment of the present invention, the two airflow channels are positioned on opposite sides of the blower.

Preferably, one of the second sidewalls limits each one of the airflow channels on one side.

Expediently, the soundproofing material is connected to the second sidewalls.

Advantageously, the flow opening has a height selected such that a flow velocity of the clean air flowing through the flow opening is less or at most identical to a flow velocity of the clean air flowing within the airflow channel.

Preferably, the blower unit further comprises a bottom plate, wherein the upwardly extending wall of the two airflow channels are positioned opposite one another and each have a lower end, wherein the bottom plate connects the lower ends.

Advantageously, the bottom plate is positioned at a distance below the blower.

Expediently, the blower has a base plate and base plate rests on the bottom plate.

Advantageously, the blower has a base plate, and the bottom plate and the base plate form a unitary part.

In another embodiment of the present invention the second sidewalls and the upwardly extending walls are parallel to one another.

Preferably, the blower unit further comprises an external rotor motor connected to the blower.

In the inventive blower unit, the air flow channel does not extend in the transverse direction but in the direction of height of the blower unit. Thus, the clean air which has been sucked in by the blower and which is introduced into the housing flows within the airflow channel from the top to the bottom. Depending on the desired degree of sound muffling, the height of the airflow channel can be varied. The grid structure and its dimensions of the blower unit thus must not be changed so that, while maintaining the dimensions of the grid structure, an optimal soundproofing can be achieved.

BRIEF DESCRIPTION OF THE DRAWINGS

The object and advantage of the present invention will appear more clearly from the following specification in conjunction with the accompanying drawings, in which:

FIG. 1 shows a view along the line I—I of FIG. 2 of an inventive blower unit;

FIG. 2 shows a cross-section of the inventive blower unit according to FIG. 1;

DESCRIPTION OF PREFERRED EMBODIMENT

Figure 2A:
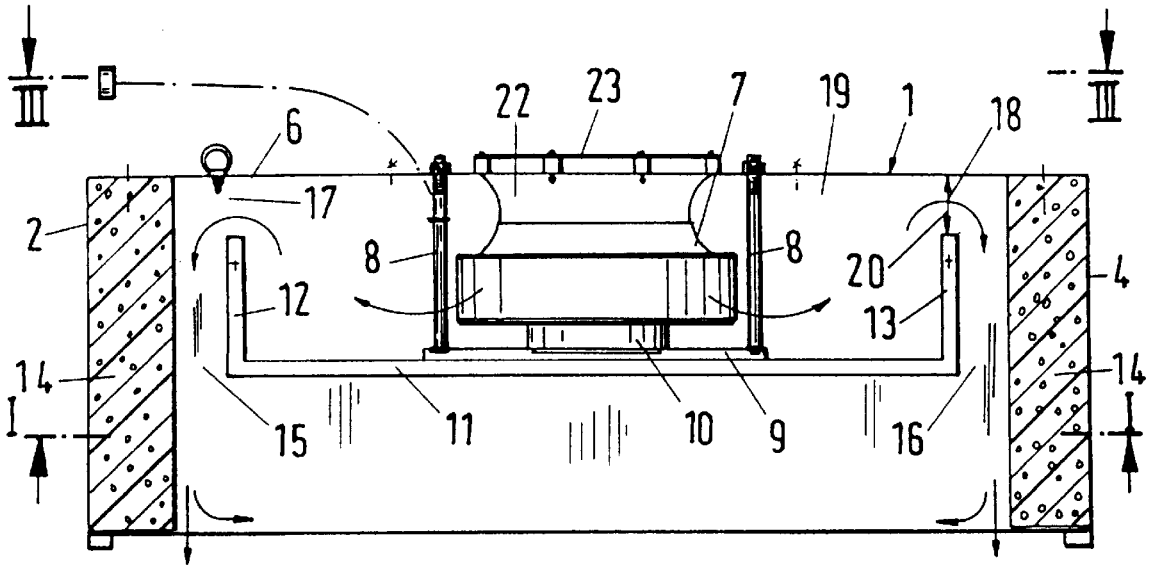
FIG. 2*a* shows a different embodiment in which the base plate of the blower rests on the bottom plate.

The present invention will now be described in detail with the aid of a specific embodiment utilizing FIGS. 1 through 4.

The blower unit has a housing 1 which is preferably of a parallelepipedal design. The housing 1 has sidewalls 2 through 5 which are positioned at a right angle to one another and which are connected by cover 6 with one another. The sidewalls 2 through 5 and the cover 6 are of a planar construction.

Figure 2B:
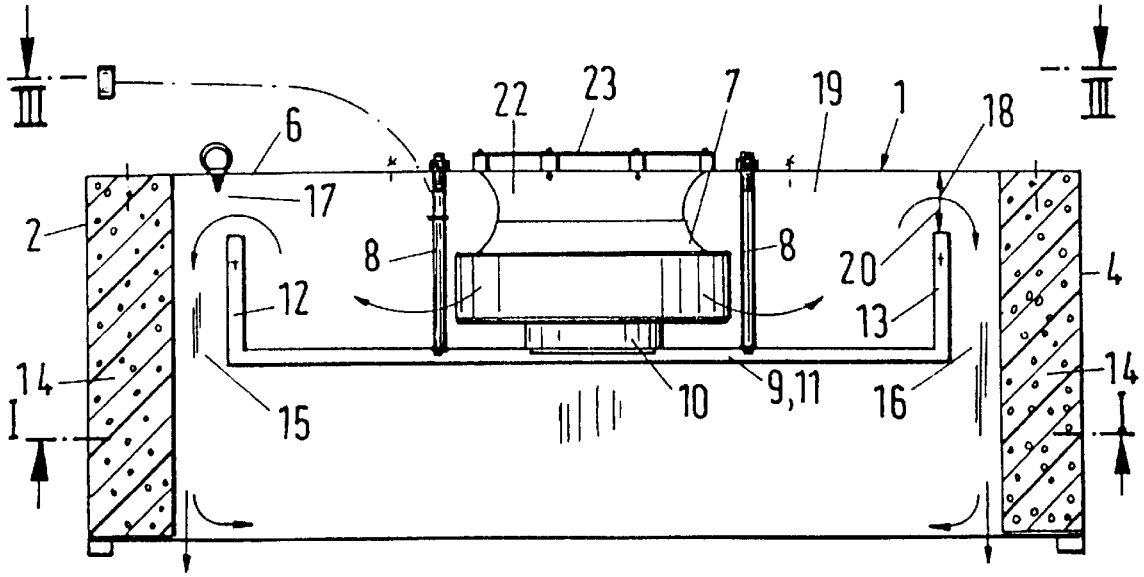
FIG. 2*b* shows another embodiment in which the base plate of the blower and the bottom plate form a unitary part.
Figure 3:
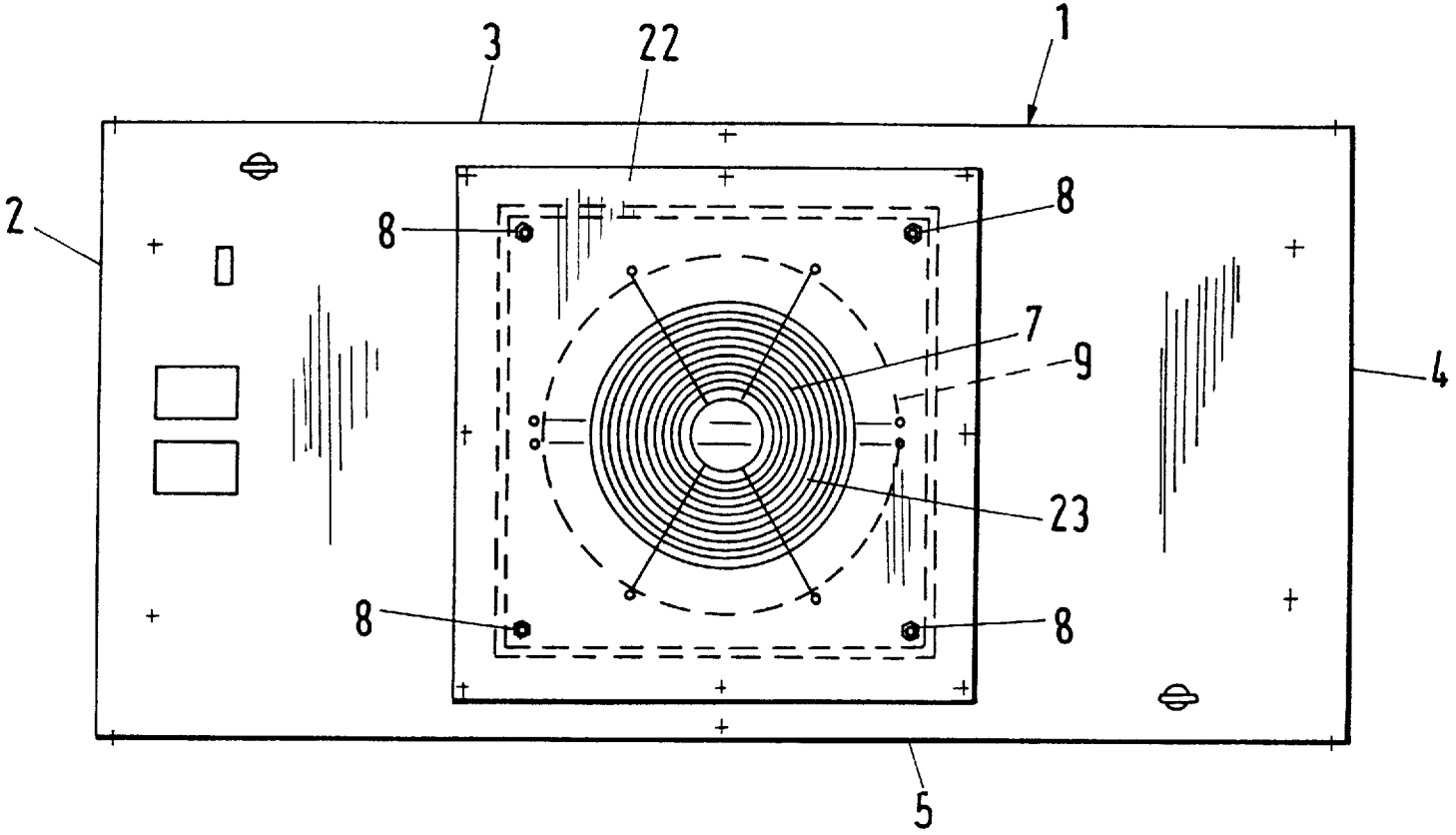
FIG. 3 shows a view along the line III—III in FIG. 2.
Figure 4:
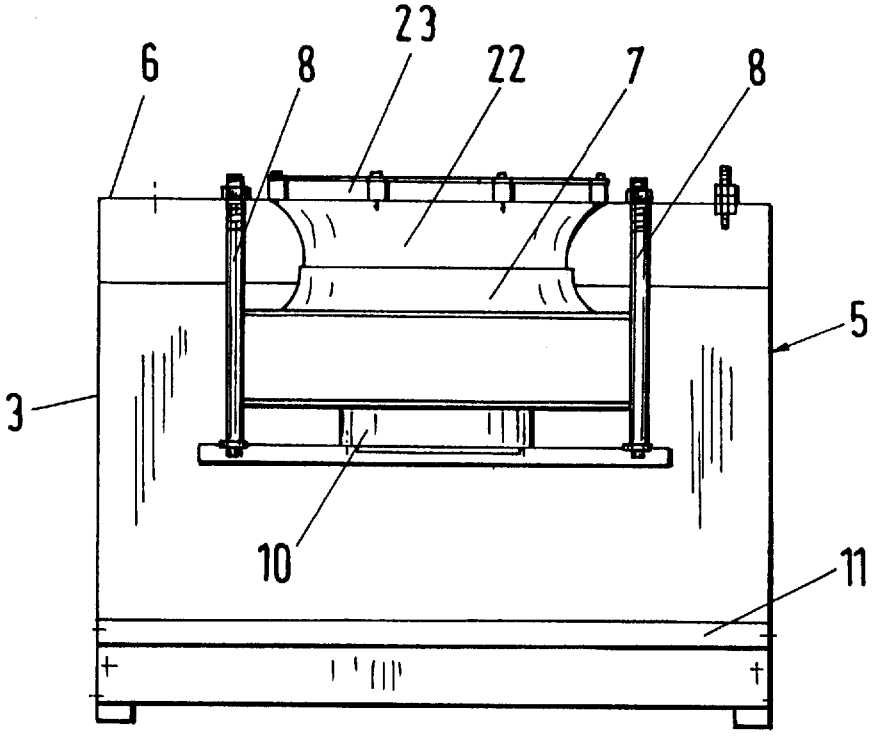
FIG. 4 shows a side view of the inventive blower unit.

The sidewalls 2 and 4 consist of profiled members which have a C-shaped cross-section (FIG. 1 and FIG. 2). The cover 6 is a plate which is resting on the upper edges, respectively, legs of the side walls 2 through 5 and is connected thereto in a suitable, well-known manner. A blower 7 is suspended from the cover 6. The blower 7 is comprised of a suction nozzle 22 a blower wheel 7, and a drive motor 10, a base plate 9, and bolts 8. The blower 7 is advantageously a radial blower and has a freely rotating wheel which in the direction of rotation is provided with blades that curve backwardly. The radial blower has the advantage that it exhibits only a very small dynamic pressure component and has a high efficiency.

The base plate 9, as shown in FIG. 1, has a square contour, is planar and is positioned at half the height of the housing 1. In the axial direction of the blower 7, the base plate 9 covers the bottom of the blower 7. Bolts 8 are provided at the corners of the base plate 9. On the base plate 9 the drive 10 for the blower 7 is supported. The drive motor 10 is advantageously an external rotor motor. It extends upwardly partially into the blower 7 (FIG. 2).

At a distance below the base plate 9 a rectangular bottom plate 11 extends between the sidewalls 3 and 5. The bottom plate 11 is connected with its two longitudinal sides to the sidewalls 3 and 5. At the narrow sides of the bottom plate 11, upwardly extending walls 12 and 13 are provided which extend vertically upwardly from the bottom plate 11 and terminate at a distance from the cover 6 (FIG. 2). The walls 12, 13 are also positioned at a distance to the sidewalls 2 and 4 of the housing. As shown in FIG. 1, the walls 12, 13 extend between the oppositely arranged longitudinal sidewalls 3 and 5 of the housing 1 which are formed by planer plates. The walls 12, 13 are positioned on opposite sides of the blower 7 at a distance to the blower 7. The walls 12, 13 are connected in a suitable manner to the longitudinal sidewalls 3, 5 of the housing 1.

The base plate 9 of the blower 7 may also rests on the bottom plate 11 or may form a unitary part therewith (see FIGS. 2*a* and 26).

The sidewalls 2 and 4 which form the narrow sides of the housing 1 are comprised of C-shaped profiled members.

Their inner side are covered with soundproofing material 14 which is, for example, mineral wool, foam material etc. This soundproofing material 14 fills the C-shaped profiled members preferably completely (FIG. 1 and FIG. 2). Between the walls 12 and 13 and the soundproofing material 14 air flow channels 15 and 16 extend over the entire width of the housing 1. Via these channels 15, 16 the clean air expelled by the blower 7 is guided in the downward direction. The two airflow channels 15, 16 are in flow connection via slot 17, 18 with the central housing part 19 that contains the blower 7. The two slots 17, 18 extend over the entire width of the housing 1.

At the underside of the housing 1 a high performance filter (not represented) is connected in a manner known per se. It has the same cross-sectional area as the housing. The air sucked in by the blower 7 flows through this high performance filter into the clean room that is arranged below the high performance filter.

The height of the slot 17, 18, i.e., the distance between the upper free end of the walls 12, 13 and the cover 6 is selected such that the flow velocity in the slots 17, 18 is smaller or at most of the same magnitude as the flow velocity in the air flow channels 15, 16. Due to this measure, it is ensured that only minimal pressure losses will occur. The height of the airflow channels 15, 16 depends on the respective soundproofing specifications. The lower the height of the air flow channel 15, 16, the smaller the soundproofing effect for an identical width of the airflow channel. In this manner, by selecting the height of the walls 12, 13 and/or selecting the distance of the walls 12, 13 from the neighboring soundproofing devices 14, an optimal soundproofing effect can be achieved in a simple and inexpensive manner.

For increasing the soundproofing effect it is advantageous to provide the upper and/or lower side of the bottom plate 11 over its entire surface area with a corresponding soundproofing material.

In the inventive blower unit, the soundproofing effect is achieved in the direction of the height of the unit, i.e., upon flowing trough the vertically arranged airflow channels 15, 16. By varying the height of the airflow channels, it is thus possible to adjust the required soundproofing effect in a simple manner without changing the grid structure of the blower unit. It is thus possible with the inventive blower units to easily achieve for the same (conventional) grid structure different soundproofing effects.

The clean air exiting in the downward direction from the airflow channels 15, 16 impacts on a high performance filter (not represented). Due to the resulting impact pressure the clean air flows also underneath the bottom plate 11 so that a uniform flow distribution over the surface of the filter is achieved.

For installing the blower 7 the cover 6 has an insert opening into which the blower 7 is inserted. The suction nozzle 22 has a peripheral edge with which the blower 7 rests along the edges of the insert opening of the cover 6 and at which it is fastened in a suitable manner. A protective grate 23 is placed onto the suction nozzle 22. The sides of the layers 14 of soundproofing material facing the walls 12, 13 are planar so that the flow of clean air flowing through the air flow channels 15, 16 is not disturbed. The walls 12, 13 and the sidewalls 2, 4 with the layers 16 of sound proofing material are advantageously positioned parallel to one another so that over the length of the airflow channels 15, 16 identical flow conditions are present.

The present invention is, of course, in no way restricted to the specific disclosure of the specification and drawings, but also encompasses any modifications within the scope of the appended claims.

What we claim is:

1. A blower unit for clean rooms, said blower unit comprising:

a housing having a bottom, a cover, and first and second sidewalls;

a filter connected to said bottom;

at least one blower mounted in said housing;

said at least one blower having two airflow channels;

said two airflow channels extending within said housing in a vertical direction between two opposite ones of said first sidewalls, wherein in said airflow channels air flows from said blower to said filter in a vertical direction from said cover to said bottom;

a soundproofing material connected to at least one side of said airflow channels;

each one of said airflow channels limited by at least one vertically upwardly extending wall with a free upper end spaced at a distance to said cover and a lower end spaced at a distance from said bottom, wherein between said cover and said free upper end a flow opening is defined; and said at least one vertically upwardly extending walls connected to said two first opposite sidewalls;

a horizontal bottom plate connecting said lower ends and connected to said two first opposite sidewalls;

wherein said flow opening has a height selected such that a flow velocity of the clean air flowing through said flow opening is less or at most identical to a flow velocity of the clean air flowing within said airflow channel.

2. A blower unit according to claim 1, wherein two of said airflow channels are provided.

3. A blower unit according to claim 2, wherein said two airflow channels extend parallel to one another.

4. A blower unit according to claim 2, wherein said two airflow channels are positioned on opposite sides of said blower.

5. A blower unit according to claim 2, wherein one of said second sidewalls delimits each one of said airflow channels on one side.

6. A blower unit according to claim 5, wherein said soundproofing material is connected to said second sidewalls.

7. A blower unit according to claim 5, wherein said second sidewalls and said upwardly extending walls are parallel to one another.

8. A blower unit according to claim 2, wherein said upwardly extending walls of said two air flow channels are positioned opposite one another.

9. A blower unit according to claim 8, wherein said bottom plate is positioned at a distance below said blower.

10. A blower unit according to claim 8, wherein said blower has a base plate and wherein said base plate rests on said bottom plate.

11. A blower unit according to claim 8, wherein said blower has a base plate and wherein said bottom plate and said base plate form a unitary part.

12. A blower unit according to claim 1, further comprising an external rotor motor connected to said blower.

* * * * *